United States Patent [19]

Sigworth et al.

[11] Patent Number: 5,055,256

[45] Date of Patent: Oct. 8, 1991

[54] GRAIN REFINER FOR ALUMINUM CONTAINING SILICON

[75] Inventors: Geoffrey Sigworth; Green Lane, Pa. Matthew Guzowski, Bowling Green, Ohio

[73] Assignee: KB Alloys, Inc., Sinking Spring, Pa.

[21] Appl. No.: 262,124

[22] Filed: Oct. 24, 1988

Related U.S. Application Data

[63] Continuation of Ser. No. 715,328, Mar. 25, 1985, abandoned.

[51] Int. Cl.[5] ..... C22C 1/03

[52] U.S. Cl. ..... 420/548; 148/437; 420/552

[58] Field of Search ..... 420/552, 548; 148/437

[56] References Cited

U.S. PATENT DOCUMENTS

| | | | |
|---|---|---|---|
| 3,634,075 | 1/1972 | Hoff | 420/552 |
| 3,676,111 | 7/1972 | Wieser et al. | 420/548 |
| 3,785,807 | 1/1974 | Backerud | 420/552 |
| 3,857,705 | 12/1974 | Miyasaka et al. | 148/437 |
| 4,298,408 | 11/1981 | Langdon et al. | 148/437 |
| 4,612,073 | 9/1986 | Guzowski et al. | 148/415 |

FOREIGN PATENT DOCUMENTS

| | | |
|---|---|---|
| 1041695 | 10/1958 | Fed. Rep. of Germany . |
| 2090888 | 1/1972 | France . |
| 2172197 | 9/1973 | France . |
| 802071 | 10/1958 | United Kingdom . |
| 1244082 | 8/1971 | United Kingdom . |
| 1452165 | 10/1976 | United Kingdom . |
| 2067222 | 7/1981 | United Kingdom . |

OTHER PUBLICATIONS

Cornish, Metal Science, 1975, vol. 9, pp. 477–484.

Miyasaka & Namekawa, Light Metals, 1975, pp. 197–211, AIME, New York, 1975.

Pearson & Birch, Light Metals, 1984, pp. 1217–1229, AIME, New York, 1984.

Wu et al., "Influence of Grain Refiner Master Alloy Addition on A-356 Aluminum Alloy," Journal of the Chinese Foundryman's Association, Jun. 1981, vol. 29, pp. 10–18.

*Primary Examiner*—R. Dean

*Attorney, Agent, or Firm*—Dickstein, Shapiro & Morin

[57] ABSTRACT

Disclosed is an Al-Ti-B master alloy especially designed to grain refine cast aluminum alloys containing silicon. The alloy composition goes contrary to present known art. Present commercial master alloys contain a ratio of Ti to B exceeding 2.2 to promote a mixture of $TiB_2$ and $TiAl_3$ crystals. This invention provides an Al-Ti-B alloy wherein the Ti to B ratio is 1. It contains a preponderance of mixed boride crystals. The optimum composition of the alloy of this invention is Al-3Ti-3B.

7 Claims, 4 Drawing Sheets

GRAIN REFINER FOR ALUMINUM CONTAINING SILICON

This application is a continuation of application Ser. No. 715,328, filed Mar. 25, 1985, abandoned.

This invention relates to aluminum-titanium-boron grain refiners that are used to control the grain size of aluminum and its alloys during solidification. More particularly, it relates to a grain refiner especially suited for aluminum casting alloys containing silicon.

BACKGROUND AND PRIOR ART

Patents

Grain refiners for aluminum castings generally contain titanium and boron in an aluminum base. Examples of these refiners may be found disclosed in U.S. Pat. Nos. 3,785,807, 3,857,705, 4,298,408 and 3,634,075. U.S. Pat. No. 3,676,111 discloses a method of refining aluminum base alloys by means of separate additions of boron and titanium. The invention teaches that (1) boron must be added to the aluminum base alloy, then (2) titanium is added with additional boron as may be required. Examples and suggestions of master alloy compositions for the titanium and boron additions in step (2) are limited to the well-known Al-3%B alloy and Al-5% Ti-1%B master alloys. The final cast alloy contains a Ti:B ratio between 1.4 and 2.2.

Publications

The subject of the best titanium-to-boron ratio for grain refinement of aluminum has been the subject of several studies. Cornish[1], Miyasaka and Namekawa[2], and Pearson and Birch[3] have all studied the question and concluded that the Ti:B ratio must be greater than 2.2 (the stoichiometric value for $TiB_2$) for grain refinement to occur.

The results are perhaps most clearly shown in FIG. 1, in which circles show the final alloy composition made by adding Ti and B as separate additions in the proper amount to 99.9% aluminum. Dark circles show compositions of castings having fine grains; open circles are coarse grained; and half-filled circles show compositions of castings having only partial grain refinement.

[1] A. J. Cornish: *Metal Science*, 1975, Vol. 9, pg. 477–484.
[2] Y. Miyasaka & Y. Namekawa: *Light Metals*, 1975, pg. 197–211, AIME, New York 1975.
[3] J. Pearson and M. E. J. Birch, *Light Metals*, 1984, pg. 1217–1229, AIME, New York, 1984.

These patents and literature references relate to various modifications of titanium-boron contents together with additional elements or certain processing steps.

The effectiveness of grain refinement is somewhat dependent upon the composition of the aluminum grain refiner and also the aluminum alloy being refined. For example the most useful commercial aluminum-base grain refiners generally contain a titanium-to-boron ratio greater than about three. In practice, it was sometimes found that the effectiveness of these commercial grain refiners was erratic and not predictable. Thus, it was necessary to determine the cause and effect of this problem. It was found, however, that such standard commercial grain refiners were ineffective when used in casting aluminum alloys containing about one percent or more of dissolved silicon. It appears that the higher silicon contents found in casting alloys somehow interferes with the effect of titanium, and promotes that of boron, as a grain refiner.

A report entitled "Influence of Grain Refiner Master Alloy Addition on A-356 Aluminum Alloy" published in the Journal of the Chinese Foundryman's Association, June 1981, Vol. 29, pg. 10–18, discloses results of an investigation of this subject. Casting Alloy A-356 contains 6.5 to 7.5 percent silicon, 0.2 to 0.4% magnesium, less than 0.2% each of iron and titanium and the balance aluminum plus normal low-level impurities. The Chinese investigation determined that an Al-4%B alloy was the best grain refiner for A-356 alloy, followed by Al-5% Ti-1%B alloy; then by Al-5% Ti alloy as the poorest grain refiner. FIG. 2 is a graphic presentation of the data.

The Cornish reference discloses a graphic relationship of Ti to B ratio. FIG. 1, herein, shows the result of the Cornish reference. The conclusions clearly teach that the ratio of Ti to B must be more than about 2 for effective results. All tests of alloys at a ratio of 1.48 indicated poor grain refinement (coarse grains). The best grain refiners were found to be with Ti to B ratios above 2.22 which is the stoichiometric proportion of $TiB_2$. FIG. 1 clearly shows this teaching.

The Pearson and Birch literature reference also teaches the Ti to B ratio to be over the stoichimetric value of 2.22. A grain refiner containing 3%Ti-I%B is reported to be the optimum composition.

Thus, the results of the Chinese study made in the Al-7%Si casting alloy (A-356) run counter to the results of Cornish[1] and Pearson and Birch[3] for higher purity (low Si) aluminum. In our own laboratory studies, we have confirmed the results of the Chinese experiments, but plant trials of the Al-4%B alloy gave many problems. So, it seemed as if there were no satisfactory grain refiners for the high silicon content aluminum casting alloys.

OBJECTS OF THE INVENTION

It is an object of this invention to provide a master alloy especially suitable for grain refining silicon-containing aluminum alloys.

Another object is to provide a master alloy that may be readily produced by processes known in the art.

Other objects may be discerned by those skilled in the art from subsequent descriptions of the invention, figures and examples.

SUMMARY OF THE INVENTION

Figure 1:
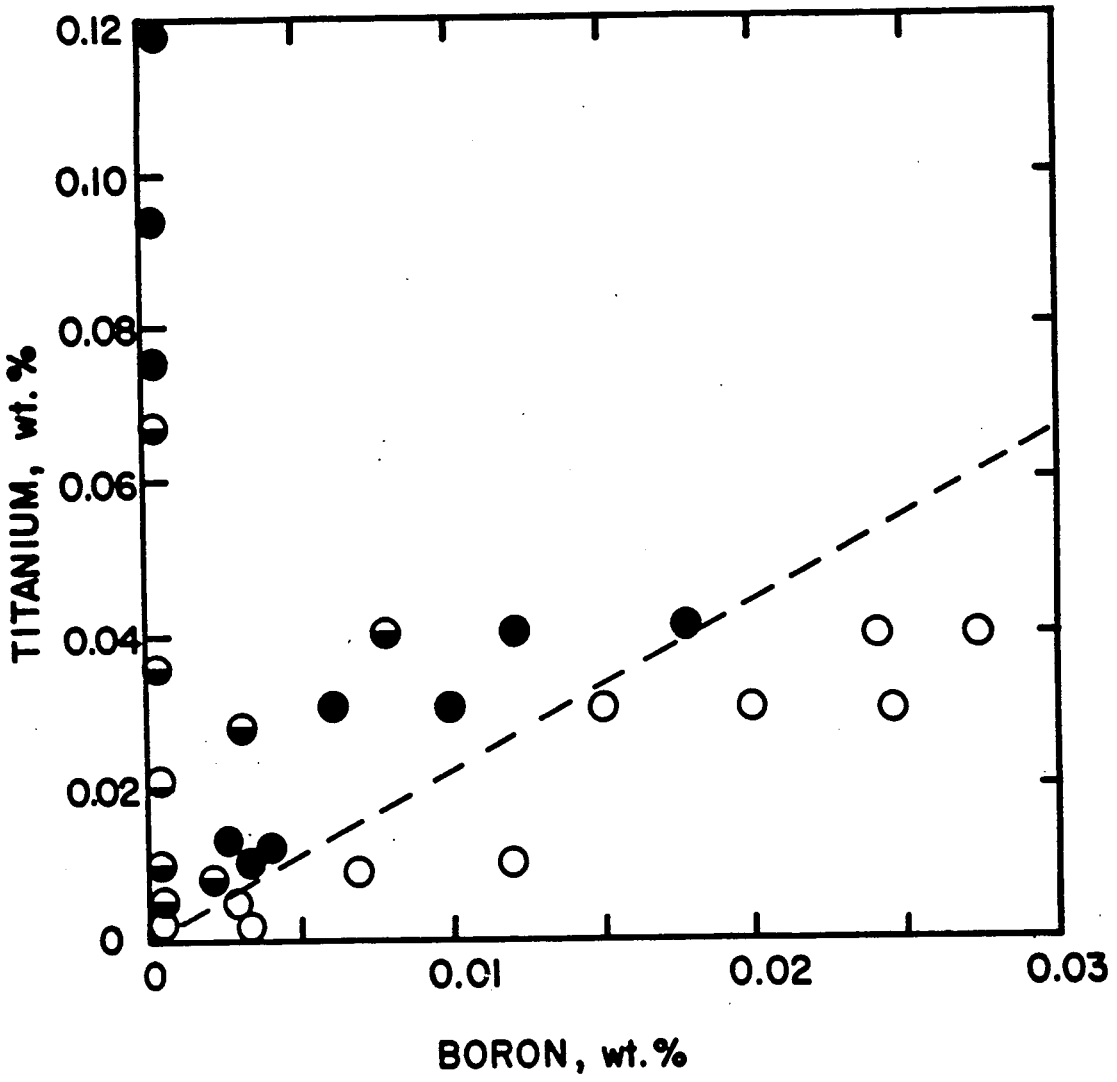
FIG. 1 shows the weight percent of titanium to boron in certain master alloys for the grain refinement of aluminum. The circles represent the final alloy composition made by adding Ti and B as separate additions in he proper amount to 99.9% aluminum. Dark circles show compositions of castings having fine grains; open circles show composition of castings having coarse grains. Half-filled circles show compositions of castings having only partial grain refinement.
Figure 2:
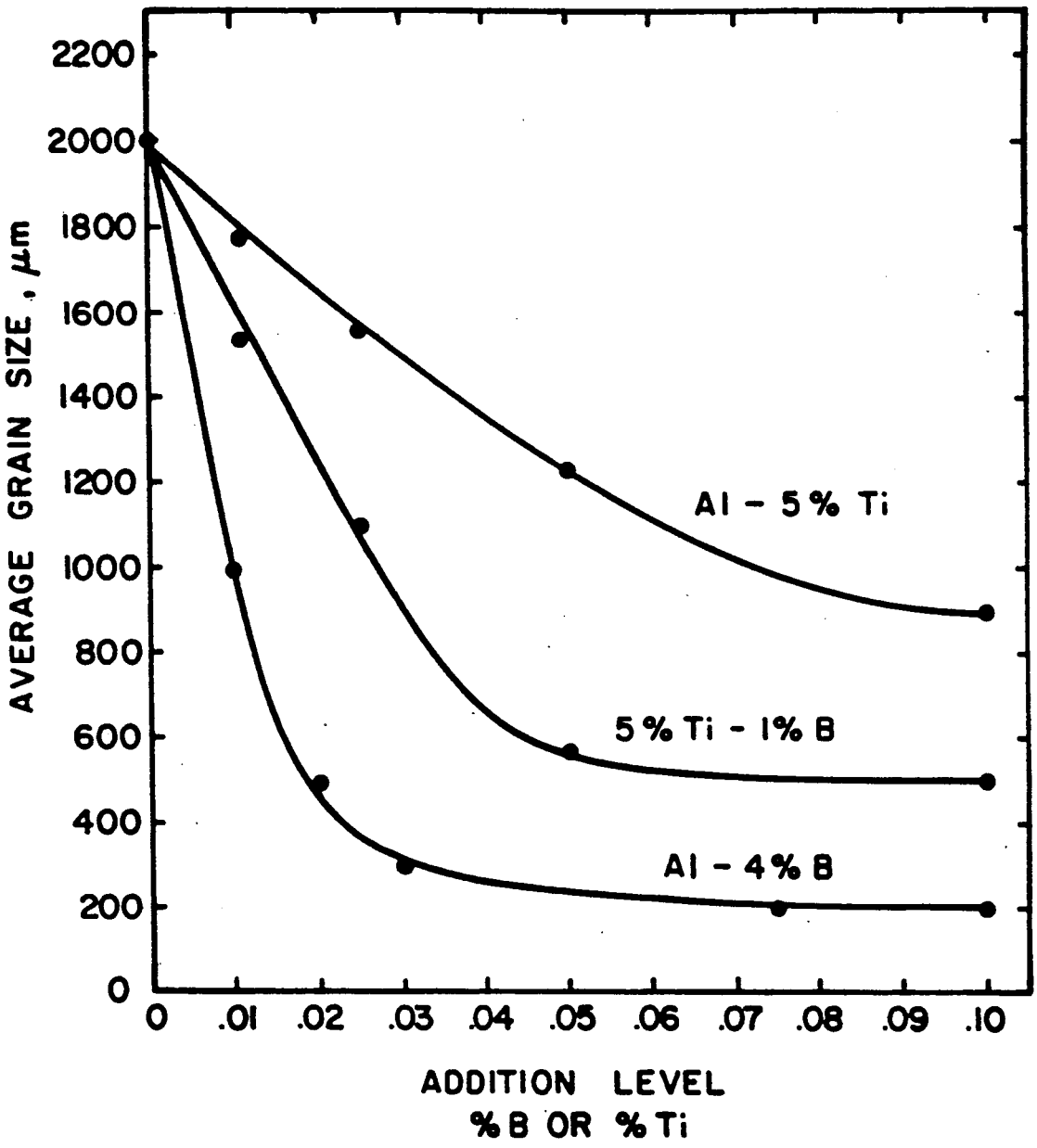
FIG. 2 shows the influence of certain grain refiner master alloy additions to A-356 aluminum alloy.

The present invention provides a novel aluminum-titanium-boron master alloy that grain refines aluminum-silicon alloys more uniformly. Table 1 presents the composition ranges of the alloy of this invention. Ternary Al-Ti-B master alloys are well known in the art and the science of aluminum grain refining. The gist of this invention resides in the critical ratio of Ti to B required to obtain grain refinement in aluminum alloys containing silicon.

The compositions in Table 1 contain aluminum plus impurities as balance. In the production of aluminum master alloys of this class, impurities from many sources are found in the final product. These so-called "impurities" are not necessarily always harmful and some may actually be beneficial or have an innocuous effect, for example, iron and copper.

Some of the "impurities" may be present as residual elements resulting from certain processing steps, or adventitiously present in the charge materials: for example, silicon, manganese, sodium, lithium, calcium, magnesium, vanadium, zinc, and zirconium.

In actual practice, certain impurity elements are kept within established limits with maximum and/or minimum to obtain uniform products as well known in the art and skill of melting and processing these alloys. Sodium, lithium, calcium, zinc, and zirconium must generally be kept at the lowest possible levels.

Thus, the alloy of this invention may contain these and other impurities, within the limits usually associated with alloys of this class.

Although the exact mechanism of the invention is not completely understood, it is believed that the required control of the titanium-to-boron ratio provides the proper balance of mixed aluminum and titanium borides that is essential to effectively grain refine aluminum alloys containing silicon.

TABLE 1

| | Alloy Of This Invention Composition, in weight percent | | |
|---|---|---|---|
| | Broad Range | Intermediate Range | Preferred Range |
| Titanium | .1 to 9.8 | 1.5 to 7 | 2.5 to 3.5 |
| Boron | .1 to 7.0 | 1.5 to 7 | 2.5 to 3.5 |
| Aluminum plus impurities | Balance | Balance | Balance |
| Ratio Ti:B | 0.1 to 2.1 | 0.25 to 1.8 | 0.7 to 1.4 |
| Total $AlB_2$ + $TiB_2$ | >50% | >75% | >90% |

EXAMPLES

Five heats of experimental alloys were made by reacting a salt mixture of $KBF_4$ and $K_2TiF_6$ with molten aluminum. This salt mixture is called a "flux" herein. Three flux compositions and three different reaction temperatures were employed, as shown in table 2 together with the compositions of the Al-Ti-B alloys made from the reaction.

TABLE 2

| | Flux Ratio and Alloy Composition | | |
|---|---|---|---|
| Reaction Temp. | 40% $K_2TiF6$/60% $KBF_4$ (2.8% Ti—1.8% B | 20% $K_2TiF_6$/80% $KBF_4$ (1.4% Ti—2.4% B) | 10% $K_2TiF_6$/90% $KBF_4$ (0.7% Ti—2.7% B) |
| 725° C. | Heat −29 | Heat −31 | Heat −39 |
| 800° C. | — | Heat −37 | — |
| 850° C. | Heat −40 | — | — |

The experimental alloys were used as grain refiners for an Al-7%Si alloy. Each was generally effective as grain refiners. However, Heats 29, 40, 31 and 37 were outstanding because the products had cleaner microstructures. Table 3 presents a tabular display of the test results.

TABLE 3

| Heat No. | Approx. Ti:B ratio | Effectiveness |
|---|---|---|
| 29 | about 1.5:1 | excellent |
| 40 | about 1.5:1 | excellent |
| 31 | about 0.6:1 | excellent |
| 37 | about 0.6:1 | excellent |
| 39 | about 1:4 | poorest |

Another series of alloys was prepared to examine the effect of other flux ratios. Table 4 presents the flux ratios and reaction temperatures employed.

TABLE 4

| Heat No. | Flux Ratio % $K_2TiF_6$/% $KBF_4$) | Reaction Temperature |
|---|---|---|
| 54 | 25/75 | 760° C. (1400° F.) |
| 55 | 15/85 | 760° C. (1400° F.) |
| 56 | 30/70 | 760° C. (1400° F.) |
| 48 | 20/80 | 800° C. (1472° F.) |

A test of the grain refining effectiveness of these Al-Ti-B master alloys in cast aluminum-7% silicon alloy revealed that Heat No. 56 was the outstanding master alloy of this entire series. Heat 56 has a 30:70 flux ratio and a reaction temperature of 760° C.

Results of the two series of tests suggest that the best practice of the invention lies between 0.7:1 and 1.4:1 ratios (preferably about 1:1 ratio) of Ti:B and a flux ratio of 30:70. To verify this conclusion a 100 lb. experimental alloy (No. 3-40) was made and tested. This alloy contained 3.1% titanium and 3.2% boron. It was produced by reacting a 30:70 flux ratio at a temperature of 760° C. (1400° F.) as indicated for alloy 56 described above.

Alloy 3-40 was used to refine the grain of commercial alloy no. 356, which contains 7%Si, 0.3% Mg, 0.1% Fe, and 0.02% Ti. The casting temperature was 725° C. (1350° F.) and the time the grain refiner was in contact with the melt before casting was 5 minutes.

Figure 3:
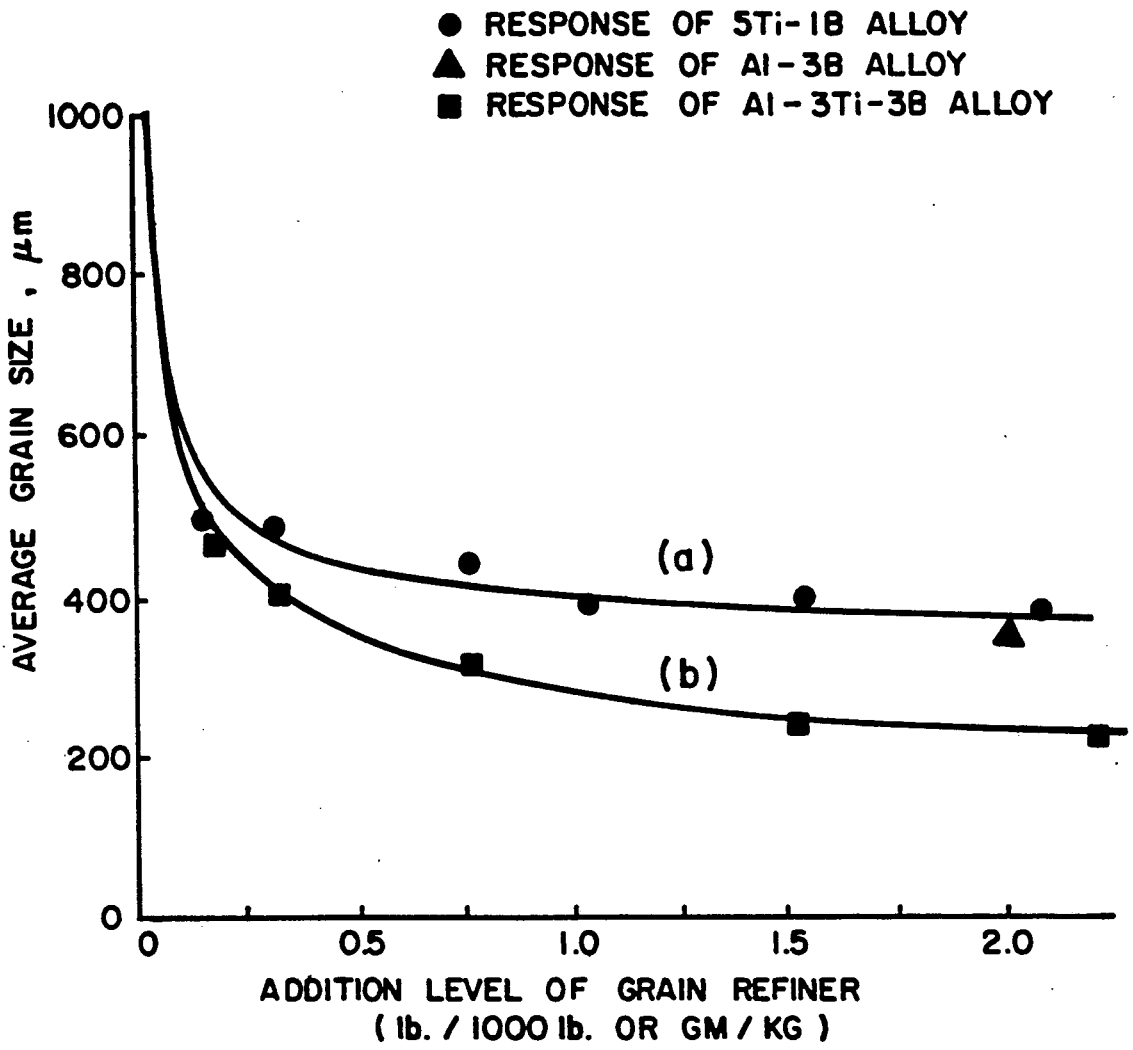
FIG. 3 shows the grain refining ability of two prior art alloys and an alloy of the invention with respect to commercial aluminum alloy no. 356.

Prior art alloys, 5%Ti-1%B, and Al-3%B were used under the same conditions as the experimental alloy 3-40. Results of the test are shown graphically in FIG. 3. The average grain size of the prior art alloys are plotted as curve (a); the average grain size of alloy 3-40 is plotted as curve (b). Clearly, these data show the alloy of this invention to be superior over the prior art alloys.

Figure 4:
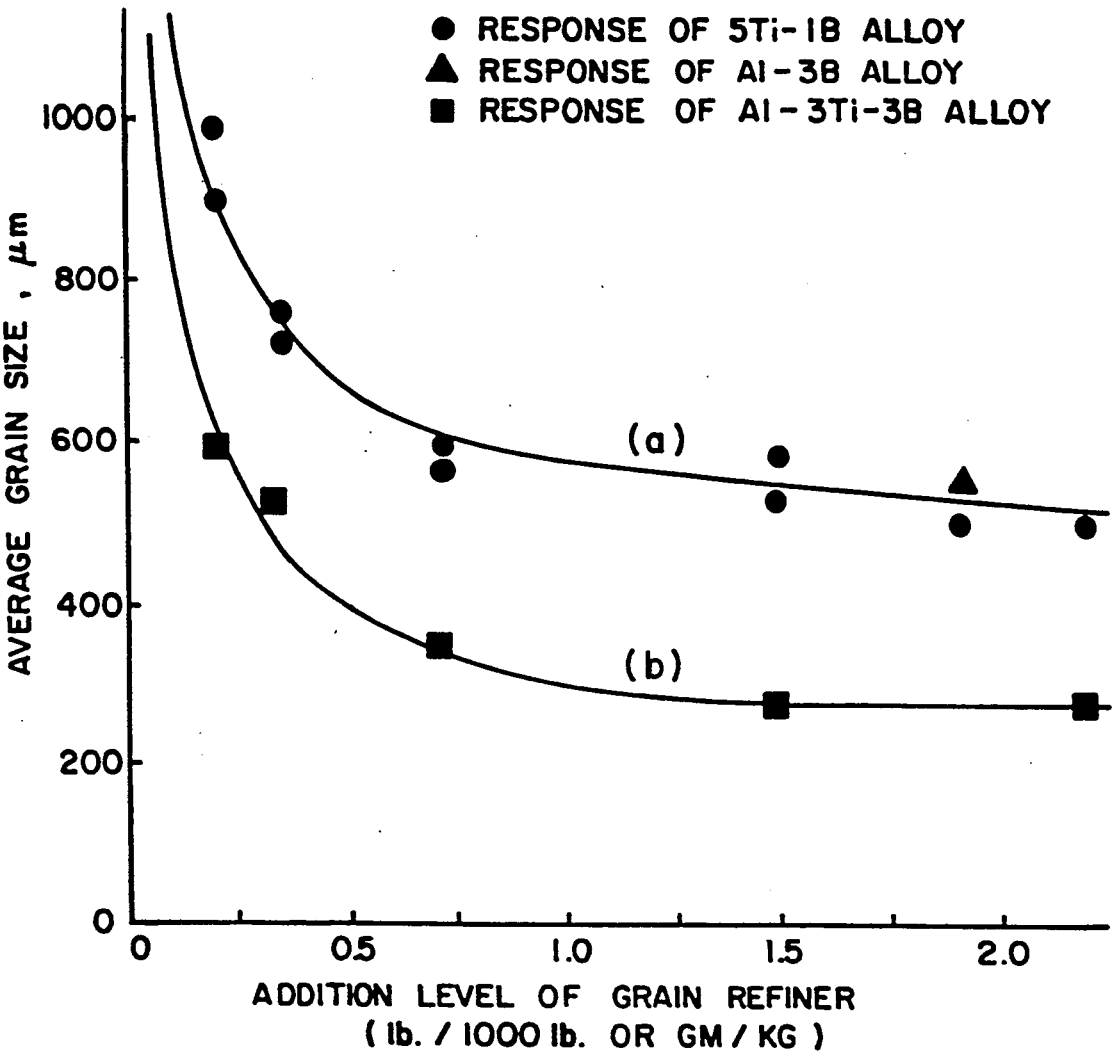
FIG. 4 shows the grain refining ability of two prior art alloys and an alloy of the invention with respect to commercial aluminum alloy no. 319.

In further testing, commercial aluminum alloy no. 319 (which contains 6%Si, 3.5%Cu, 1%Fe, 1%Zn and 0.5%Mn) was also grain refined by the three master alloys mentioned above. FIG. 4 is a graphic presentation of the test results. Here, also the alloy of this invention alloy (No. 3-40) was superior over the prior art alloys. Prior art alloy 5%Ti-1%B is a well known commercial master alloy with a Ti to B ratio of 5:1.

A metallographic study of all master alloys described above was made. The alloy described in this invention contained a preponderance of mixed aluminum and titanium borides, that is from about 50% to over 90% mixed borides. This is in contradiction with the known art which teaches that solely titanium boride phases (especially $TiB_2$) and titanium aluminides ($TiAl_3$) are preferred.

What is claimed is:

1. A method of making a master alloy capable of grain refining commercial aluminum alloys containing over 1% silicon comprising the steps of:

reacting molten aluminum with a mixture of $K_2TiF_6$ and $KBF_4$ by stirring said mixture into said molten aluminum, wherein the flux ratio of $K_2TiF_6$:$KBF_4$ is about 30:70, to produce a molten alloy consisting essentially of aluminum, titanium, and boron; and casting said molten alloy to produce said master alloy having a Ti:B ratio of about 1:1, wherein a sufficient amount of said salt is used to produce a master alloy consisting essentially of, in weight percent, 2.5 to 3.5 titanium, 2.5 to 3.5 boron, and the balance aluminum plus impurities, said master alloy being further characterized by having over 90% of its borides in the form of mixed borides.

2. The master alloy produced by the process of claim 1.

3. A master alloy characterized by being capable of grain refining commercial aluminum alloys containing over 1% silicon consisting essentially of, in weight percent, 2.5 to 3.5 titanium, 2.5 to 3.5 boron, and the balance aluminum plus impurities wherein the Ti:B ratio is between 0.7 to 1.4 and over 75% of the borides in said master alloy are in the form of mixed borides.

4. The master alloy of claim 3, wherein said weight percent of titanium is 3 and said weight percent of boron is 3.

5. A method of making a master alloy capable of grain refining commercial aluminum alloy containing over 1% silicon comprising the steps of:

reacting molten aluminum with a mixture of a titanium-containing salt and a boron-containing salt by stirring said mixture into said aluminum to produce a molten alloy consisting essentially of aluminum, titanium, and boron; and casting said molten alloy to produce said master alloy, wherein the ratio of said titanium-containing salt to said boron-containing salt is such that the Ti:B ratio in said master alloy is between 0.7 to 1.4 and wherein a sufficient amount of said mixture is used to produce a master alloy consisting essentially of, in weight percent, 2.5 to 3.5 titanium, 2.5 to 3.5 boron, and the balance aluminum plus impurities, said master alloy being further characterized by having over 75% of its borides in the form of mixed borides.

6. The master alloy produced by the process of claim 5.

7. A method of grain refining an aluminum alloy containing over 1% silicon comprising the addition of the master alloy of claim 4 to a molten mass of said aluminum alloy.

* * * * *